US006685876B1

(12) United States Patent
Murata et al.

(10) Patent No.: US 6,685,876 B1
(45) Date of Patent: Feb. 3, 2004

(54) METHOD FOR AUTOMATICALLY CONTROLLING HYDRAULIC OPENER

(75) Inventors: Tarumi Murata, Kitakyushu (JP); Toshiya Kitagawa, Kitakyushu (JP); Masaaki Nogami, Kitakyushu (JP)

(73) Assignees: Nippon Steel Corporation, Tokyo (JP); Nittetsu Plant Designing Corporation, Fukuoka (JP)

( * ) Notice: Subject to any disclaimer, the term of this patent is extended or adjusted under 35 U.S.C. 154(b) by 0 days.

(21) Appl. No.: 10/031,273

(22) PCT Filed: Apr. 5, 2000

(86) PCT No.: PCT/JP00/02205

§ 371 (c)(1),
(2), (4) Date: Oct. 26, 2001

(87) PCT Pub. No.: WO00/65101

PCT Pub. Date: Nov. 2, 2000

(30) Foreign Application Priority Data

Apr. 26, 1999 (JP) ..... 11-118076

(51) Int. Cl.[7] ..... C21B 7/12
(52) U.S. Cl. ..... 266/45; 266/89; 266/271
(58) Field of Search ..... 222/590, 591; 266/45, 271, 78, 89

(56) References Cited

U.S. PATENT DOCUMENTS 4,023,626 A 5/1977 Salmi et al.
4,097,033 A * 6/1978 Mailliet ..... 266/271
4,246,973 A 1/1981 Mayer
4,497,379 A 2/1985 Mailliet et al.
5,246,208 A * 9/1993 Mailliet et al. ..... 266/271
5,511,768 A * 4/1996 Kremer et al. ..... 266/271

FOREIGN PATENT DOCUMENTS

EP 0 519 397 12/1992
JP 404371508 A * 12/1992 ..... 266/271

OTHER PUBLICATIONS

Patent Abstracts of Japan, JP 08–232006, Sep. 10, 1996.
Patent Abstracts of Japan, JP 04–371507, Dec. 24, 1992.

* cited by examiner

*Primary Examiner*—Scott Kastler
(74) *Attorney, Agent, or Firm*—Kenyon & Kenyon

(57) ABSTRACT

An automatic control method for a taphole opener for opening a taphole by giving impact and rotation to a drill unit holding a drilling rod and driving the drill unit forward and backward by a hydraulically driven feed motor, which method comprises the steps of; detecting the driving load in the form of detected hydraulic pressure, stopping the driving but maintaining the rotation when said detected pressure reaches an upper limit set value beyond which buckling may occur, and resuming the driving when said detected pressure falls to a lower limit set value or below. The drilling rod of the drills unit is prevented from buckling and idle hitting and a quicker taphole opening operation and enhanced accuracy of taphole depth can be obtained. Thus remote operation is made possible through the automation of the taphole opening work.

5 Claims, 6 Drawing Sheets

METHOD FOR AUTOMATICALLY CONTROLLING HYDRAULIC OPENER

FIELD OF THE INVENTION

The present invention relates to a control method for an opener for a blast furnace taphole.

DESCRIPTION OF THE PRIOR ART

In the operation of a blast furnace to produce pig iron, a taphole is opened, using an opener, to tap hot metal from the furnace. Japanese Unexamined Patent Publication No. 6-322420, for example, describes a taphole opener as shown in FIG. 4. According to the figure, the taphole opener opens a taphole 6 of a blast furnace, using a drilling rod 2 held by a drill unit 1, by giving impact and rotation to the drill unit 1, and drives the drill unit 1 forward and backward using a feed motor 5 installed on a guide cell 3 and driven by hydraulic power supplied from a hydraulic unit 4. A pulse generator 7 is connected with the rotary shaft of the feed motor 5. An arithmetical unit 9 is provided for counting output pulses of the pulse generator 7 upon receiving a tapping commencement signal. The driven distance of the drill unit 1 is counted by the pulse generator 7 in the form of the number of pulses, and the hydraulic pressure during the taphole opening operation is continuously monitored by a pressure gauge 8 to measure the depth of the taphole 6.

FIGS. 5(*a*) and 5(*b*) are flowcharts showing the control flow of the aforementioned taphole opener. Once the taphole opening operation begins (step 1), the pressure gauge detects hydraulic pressure (step 2).

The detected hydraulic pressure is input to the arithmetical unit, which judges whether the detected pressure B is equal to or higher than a set pressure A (step 3). If the detected pressure B is lower than the set pressure, the tip of the drilling rod has not reached a plugging material in the taphole and, then, the control flow returns to steps 1 and 2 and the forward driving of the drilling rod is maintained until the tip of the rod reaches the plugging material in the taphole.

When the tip of the drilling rod hits the plugging material in the taphole during the forward driving of the rod, the detected pressure B exceeds the set pressure A and, at that time, the value of the position detected is set to zero (step 4) and the counting starts (see FIG. 5 (*a*)).

The rod is driven forward under visual monitoring to determine whether the forward movement proceeds normally and whether any bend occurs in the drilling rod (see FIG. 5(*b*)). In the meantime, the number of the pulses is accumulated, and when the taphole opening is completed, a tapping commencement signal is turned on (step 6), the drilling depth of the taphole is calculated from the accumulated number of pulses (step 7), and the calculated result is shown on the output (step 8).

In the above-mentioned taphole opener, however, the forward movement speed of the drilling rod is controlled manually so that the rod may not buckle and, for this reason, the control is imperfect when the hardness and strength of the plugging material in the taphole change resulting in large drilling resistance. As a result, the drilling rod sometimes suffers bending and its tip tends to wear very rapidly.

In addition, since the impacts are also controlled manually, visually monitoring if the forward movement is sufficient, an impactor of the drill unit sometimes hits idly when the resistance against the forward driving is small, resulting in shorter service life or damage to the equipment.

Further, after the commencement of the taphole drilling is detected, detection of the drill depth in the taphole and rapid increase in the forward driving speed are confirmed also visually, and therefore accurate measures may not always be taken due to a slow reaction time.

Further yet, since the taphole opening operation is one of the cast house operations wherein the taphole opener is manually operated by a worker visually monitoring its forward movement speed, there is a problem that work environment of the operator is hot, dangerous and dirty with much dust.

SUMMARY OF THE INVENTION

The present invention provides an automatic control method for a hydraulic taphole opener, whereby a drilling rod of a drill unit can be prevented from buckling and idle hitting, the taphole opening time can be shorter, and taphole depth can be measured more accurately, making remote operation possible through automatic operation of taphole opening work to liberate workers from a foul work environment.

The gist of the present invention is as follows:

(1) An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected hydraulic pressure;

stopping the driving but maintaining the rotation when said detected pressure reaches an upper limit set value beyond which buckling may occur; and resuming the driving when said detected pressure falls to a lower limit set value or below.

(2) An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected hydraulic pressure;

maintaining the impact when said detected pressure is equal to or higher than a set value to commence the impact; and stopping the impact when said detected pressure is lower than said set value.

(3) An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected pressure;

setting the count of position detection to zero when the detected pressure exceeds an upper limit set value for detecting that the drill unit has reached a plugging material in the taphole, commencing position detection from this position, and calculating the depth of the taphole;

stopping the driving of the drilling rod when the taphole depth according to the position detection becomes equal to or deeper than a set value and the detected pressure becomes equal to or lower than a lower limit set value for detecting that the taphole has been perforated;

stopping the driving but maintaining the rotation when, during the forward driving of the drilling rod, said detected pressure reaches an upper limit set value beyond which buckling may occur; and resuming the driving when said detected pressure falls to a lower limit set value or below.

(4) An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected pressure;

setting the count of position detection to zero when the detected pressure exceeds an upper limit set value for detecting that the drill unit has reached a plugging material in the taphole, commencing position detection from this position, and calculating the depth of the taphole;

stopping the driving of the drilling rod when the taphole depth according to the position detection becomes equal to or deeper than a set value and the detected pressure becomes equal to or lower than a lower limit set value for detecting that the taphole has been perforated;

maintaining the impact when, during the forward driving of the drilling rod, said detected pressure is equal to or higher than a set value to commence the impacts; and stopping the impact when said detected pressure is lower than said set value.

(5) An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected pressure;

setting the count of position detection to zero when the detected pressure exceeds an upper limit set value for detecting that the drill unit has reached a plugging material in the taphole, commencing position detection from this position, and calculating the depth of the taphole;

stopping the driving of the drilling rod when the taphole depth according to the position detection becomes equal to or deeper than a set value and the detected pressure becomes equal to or lower than a lower limit set value for detecting that the taphole has been perforated;

stopping the driving but maintaining the rotation when, during the forward driving of the drilling rod, said detected pressure reaches an upper limit set value beyond which buckling may occur;

resuming the driving when said detected pressure falls to a lower limit set value or below;

further, maintaining the impact when, during the forward driving of the drilling rod, said detected pressure is equal to or higher than a set value to commence the impact; and stopping the impact when said detected pressure is lower than said set value.

BRIEF DESCRIPTION OF THE DRAWINGS

FIG. 1(*b*) is a graph showing the relationship between the load and hydraulic load detection according to the automatic driving control shown in FIG. 1(*a*).

FIG. 2(*b*) is a graph showing the relationship between the load and hydraulic load detection according to the automatic impact control shown in FIG. 2(*a*).

FIG. 5(*b*) is a flowchart subsequent to the flowchart shown in FIG. 5(*a*) showing the control of a conventional taphole opener.

THE MOST PREFERRED EMBODIMENT

The present invention is described in detail hereafter while referring to the attached figures.

(1) Automatic Driving Control

Figure 1A:
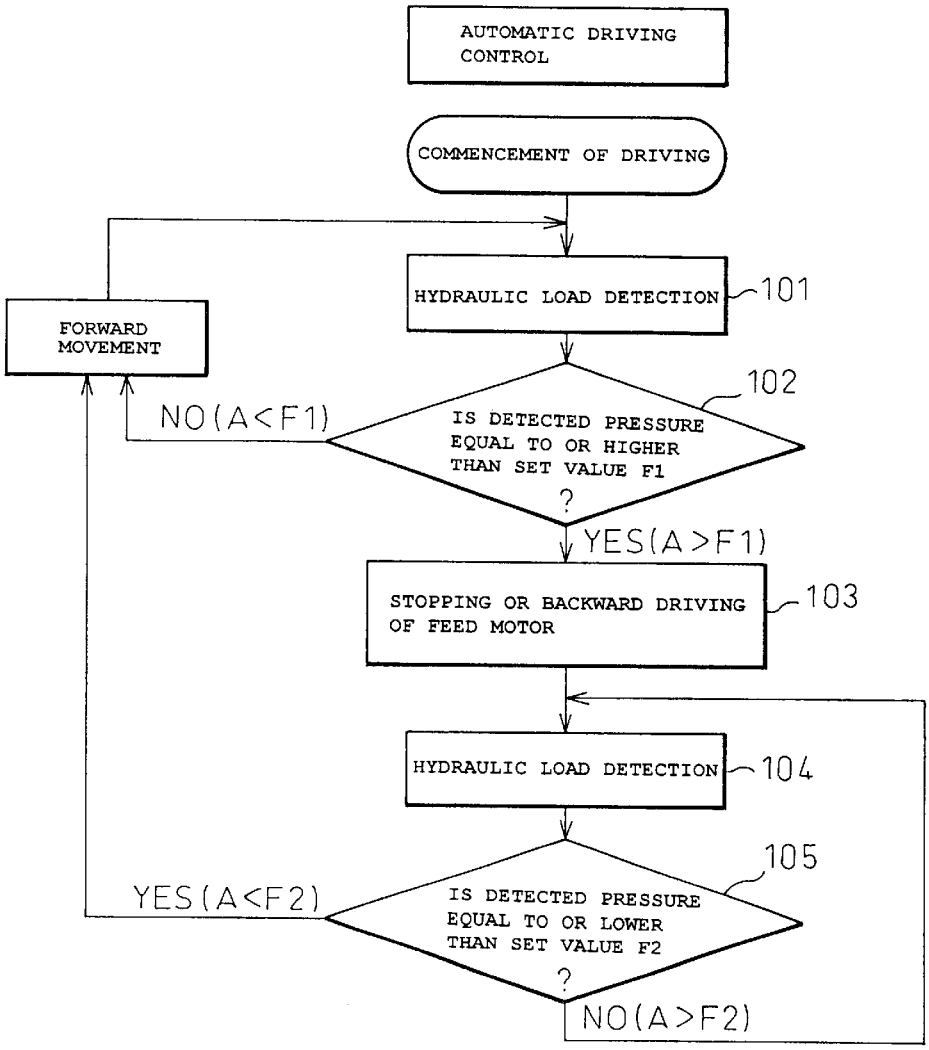
FIG. 1(*a*) is a flowchart for automatic driving control according to the control method of the present invention.
Figure 1B:
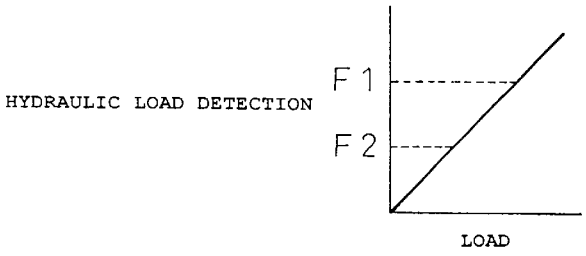

FIG. 1(*a*) is a flowchart for automatic driving control according to the control method of the present invention.

A drilling rod is rotated and driven forward by a feed motor upon commencement of driving and the hydraulic load of a hydraulic unit driving the feed motor is detected by a pressure gauge (step 101, see FIG. 1(*b*)).

The detected pressure is input to an arithmetic unit and a judgement is made as to whether the detected pressure A is equal to or higher than an upper limit set value F1 of the driving load (step 102). If the detected pressure A is lower than the upper limit set value F1, then the driving load does not exceed the value to cause buckling and therefore the drilling rod maintains rotation and is driven forward through the repetition of steps 101 and 102.

If the detected pressure A exceeds the upper limit set value F1, the driving load is in a range to possibly cause buckling and therefore the feed motor is stopped to stop the forward driving of the drilling rod, or the drilling rod is driven backward if the situation so requires (step 103).

The hydraulic load is detected while the forward driving of the drilling rod is suspended but its rotation is maintained (step 104, see FIG. 1(*b*)), and a judgement is made as to whether the detected pressure A is equal to or lower than a lower limit set value F2 (step 105). If the detected pressure A is equal to or lower than the lower limit set value F2, the control flow returns to steps 101 and 102 and the drilling rod is driven forward while maintaining the rotation.

The reason why the lower limit set value F2 is set to lower than the set value F1 is to drive the drilling rod forward at a driving load not likely to cause buckling by returning to steps 101 and 102.

When the detected pressure A exceeds the set value F2, step 104 to detect the hydraulic load and step 105 to judge whether the detected pressure A is equal to or lower than the set value F2 are repeated once again. Then, if the detected pressure A is brought to be equal to or lower than the set value F2 by the rotation of the drilling rod, the driving is commenced by returning to steps 101 and 102.

By the steps described above, the driving load is detected and, when the load reaches the upper limit set value F1 beyond which buckling may occur, the forward driving is suspended and only the rotation is retained, and, when the driving load falls to the lower limit set value F2 or below, the forward driving is resumed. The above measures prevent an excessive driving action to cause bucking of the drilling rod from occurring.

(2) Automatic Impact Control

Figure 2A:
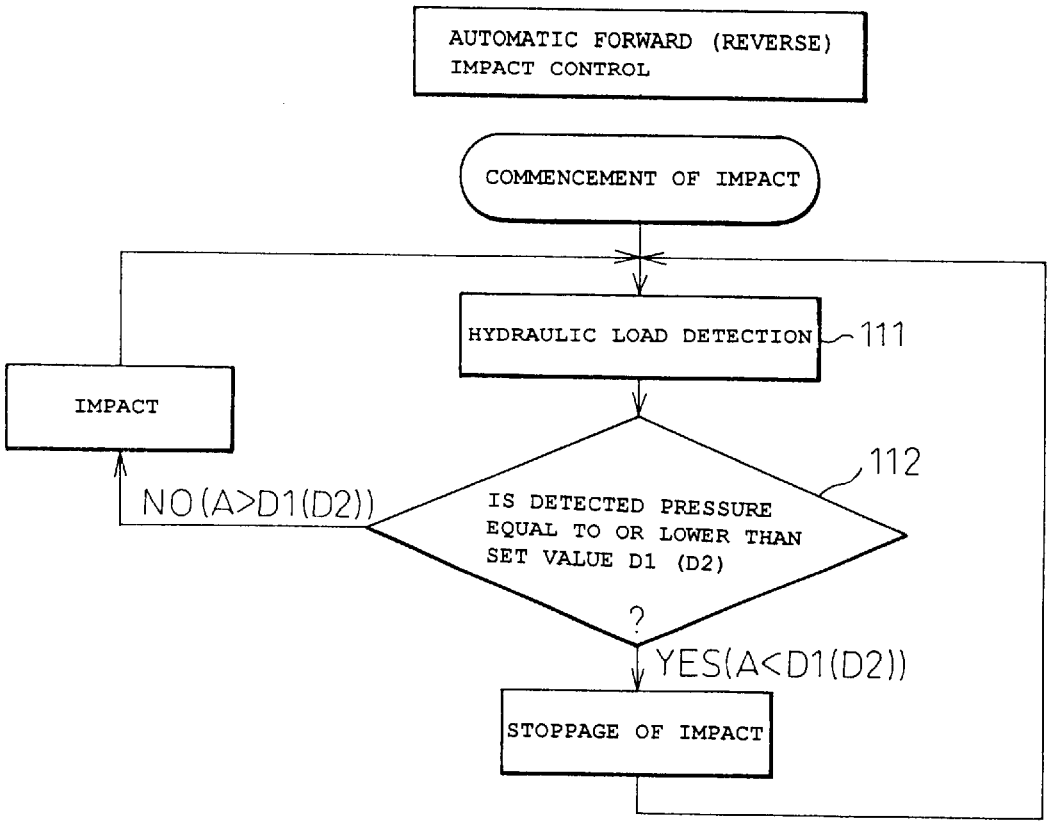
FIG. 2(*a*) is a flowchart for automatic impact control according to the control method of the present invention.
Figure 2B:
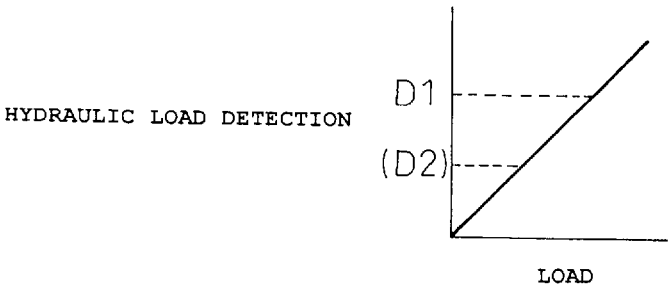

FIG. 2(*a*) is a flowchart for automatic impact control according to the control method of the present invention.

When impacts are given, a drilling rod hits a plugging material in a taphole, driven by an impactor. The hydraulic load in this condition is detected (step 111, see FIG. 2(*b*)).

The detected pressure is input to an arithmetic unit and a judgement is made as to whether the detected pressure A is equal to or lower than a set value D1 (D2, in the case of reverse impacts) to commence the impacts (step 112). If the detected pressure A is equal to or higher than the set value D1 (D2), the impacts are effectively done and do not hit idly, and therefore the impacts are maintained by returning to steps 111 and 112.

If the detected pressure A falls to lower than the set value D1 (D2), the impacts are not effectively done and possibly hit idly, and therefore the impacts are suspended (step 113). After that, the impacts are resumed when the detected pressure A recovers. This control prevents the impactor from idle hitting.

(3) Detection of Taphole Depth

Figure 3:
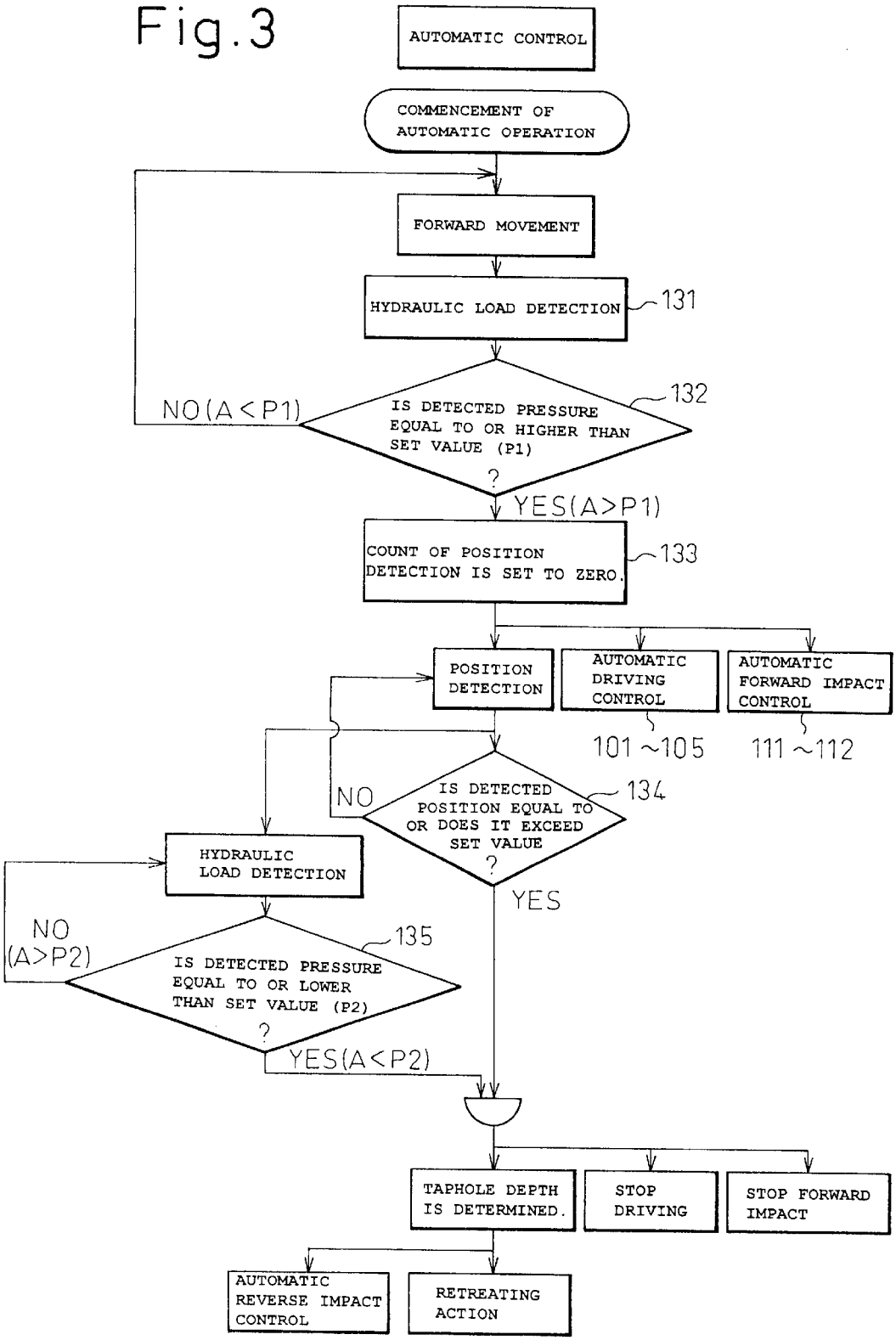
FIG. 3 is a flowchart for the control method according to the present invention.
Figure 4:
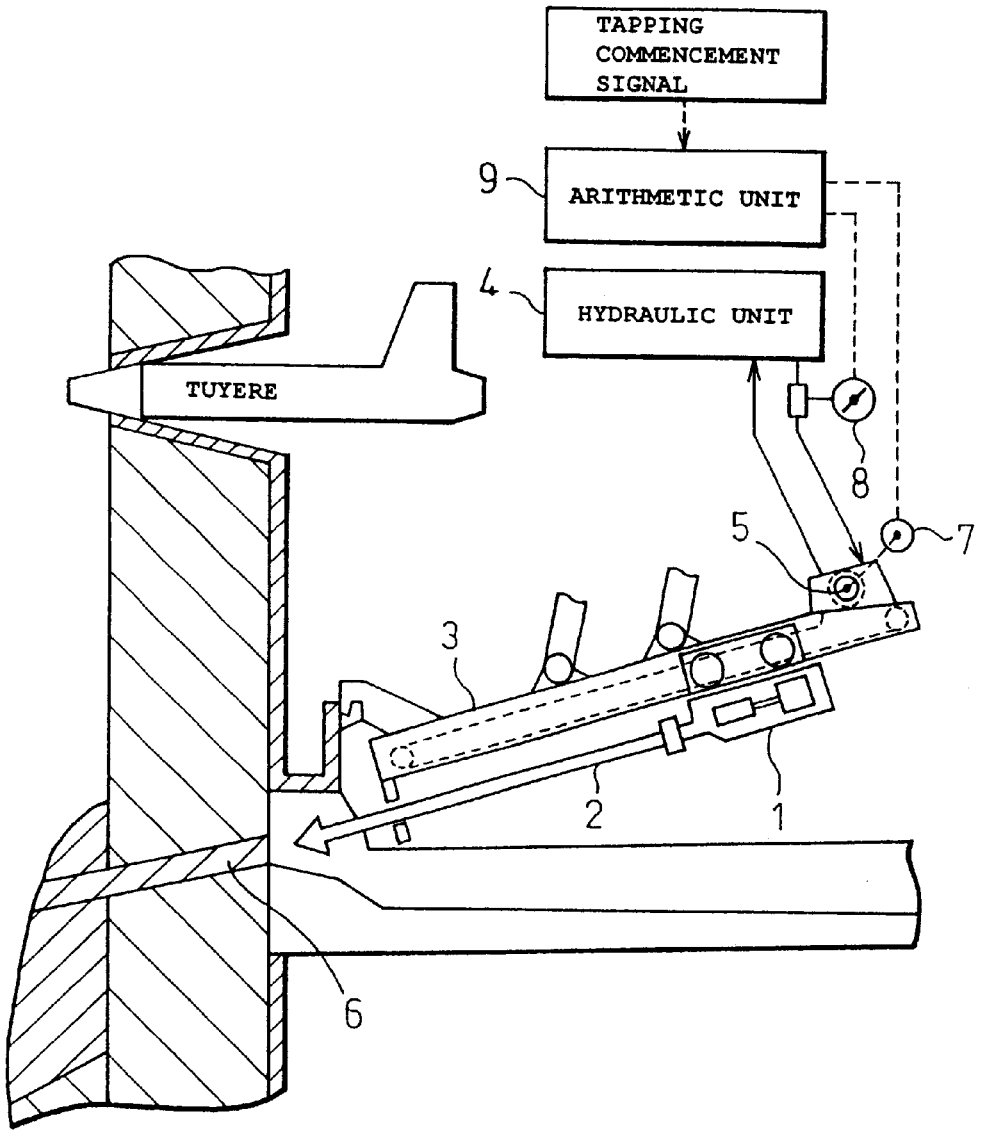
Fig. 4 PRIOR ART
FIG. 4 is a general view for a conventional taphole opener.
Figure 5A:
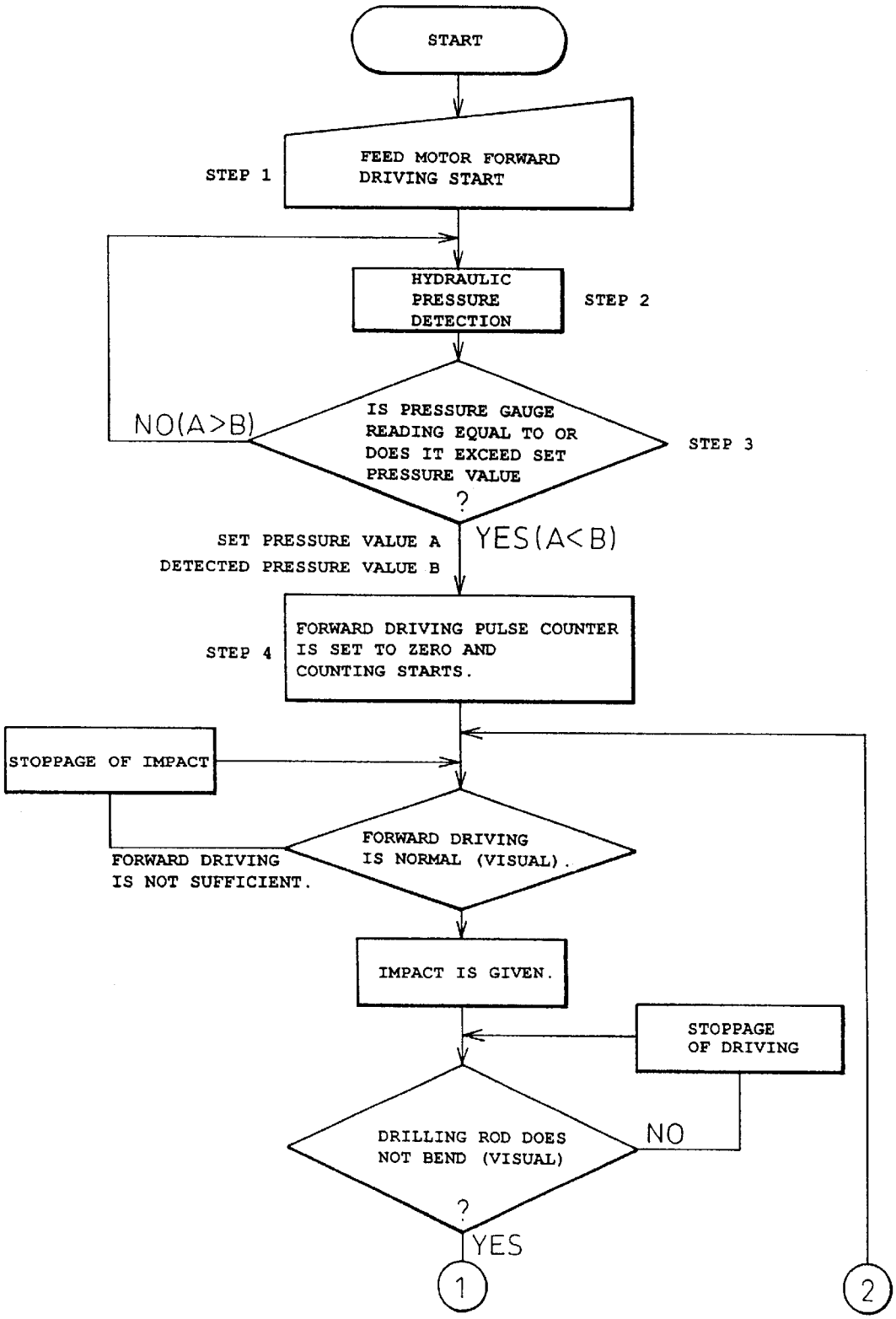
Fig.5(a) PRIOR ART
FIG. 5(*a*) is a flowchart showing the control of a conventional taphole opener.
Figure 5B:
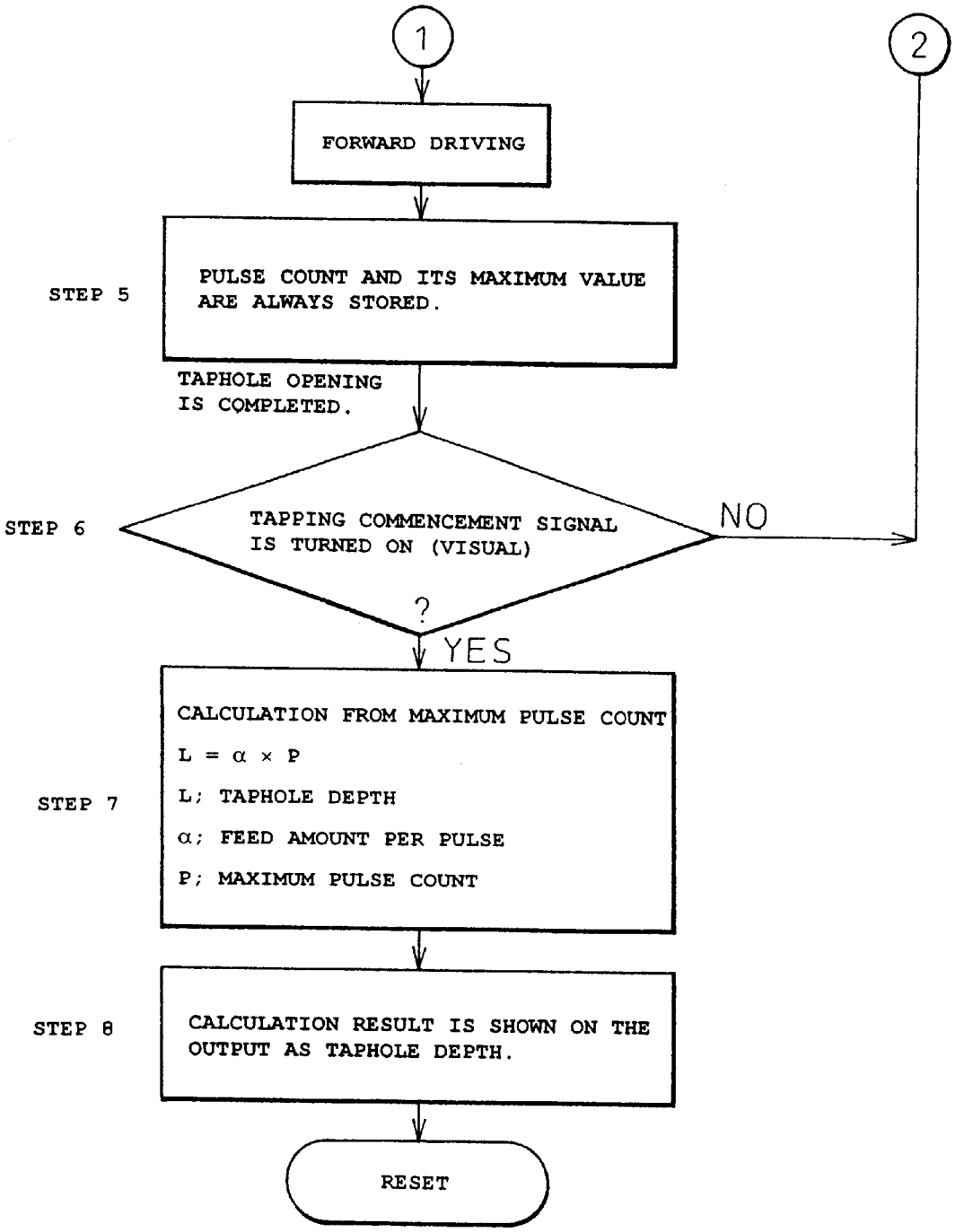
Fig.5(b) PRIOR ART

FIG. 3 is a flowchart for the control method according to the present invention. Upon commencement of a taphole opening operation, a drilling rod is rotated and driven forward by a feed motor, and the hydraulic load of a hydraulic unit driving the feed motor is detected with a pressure gauge (step 131).

The detected pressure is input to an arithmetic unit and a judgement is made as to whether the detected pressure A is equal to or lower than an upper limit set value P1 (step 132). If the detected pressure A is equal to or lower than the upper limit set value P1, the tip of the drilling rod has not yet reached a plugging material in a taphole and then, the control flow returns to steps 131 and 132 and the drilling rod maintains rotation and is driven forward. The rod is driven until the tip of the rod hits the plugging material in the taphole by, repeating steps 131 and 132.

When the rod tip hits the taphole plugging material during the forward driving, the detected pressure A exceeds the upper limit set value P1 and, at that time, the value of position detection is set to zero (step 133), position detection is commenced from this position, and the depth of the taphole is calculated. The drilling rod is driven forward while the automatic driving control, under steps 101 to 105, and the automatic forward impact control, under steps 111 and 112, are carried out as described above in parallel with the position detection. While the drilling rod thus advances, a calculation is made as to whether the detected position is at or beyond a set position (step 134) and, at the same time, the hydraulic load is detected and another calculation is made as to whether the detected pressure A is equal to or lower than a lower limit set value P2 (step 135).

When the detected position reaches to or beyond the set position in step 134 and the detected pressure A becomes equal to or lower than the lower limit set value P2, by the drop of the detected pressure A resulting from the perforation of the tip of the drilling rod through the taphole in step 135, the taphole depth is determined by an AND circuit 136 and both the driving and forward impacts of the drilling rod are stopped. After this, the drilling rod undergoes a retreating action to be extracted from the taphole and is driven backward under automatic reverse impact control.

INDUSTRIAL APPLICABILITY

By the driving control of the present invention, the buckling of a drilling rod can be reliably avoided and the time required for taphole opening work can be reduced since an excessive driving force possibly causing buckling is automatically prevented from occurring.

Further, damage to the equipment can be reduced and the service life can be extended since the equipment is automatically and reliably prevented from idle hitting. In addition, workers can be liberated from a foul environment since remote operation is made possible through the automation of taphole opening work.

What is claimed is:

1. An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected hydraulic pressure;

stopping the driving but maintaining the rotation when said detected pressure reaches an upper limit set value beyond which buckling may occur; and resuming the driving when said detected pressure falls to a lower limit set value or below.

2. An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected hydraulic pressure;

maintaining the impact when said detected pressure is equal to or higher than a set value to commence the impact; and stopping the impact when said detected pressure is lower than said set value.

3. An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected pressure;

setting the count of position detection to zero when the detected pressure exceeds an upper limit set value for detecting that the drill unit has reached a plugging material in the taphole, commencing position detection from this position, and calculating the depth of the taphole;

stopping the driving of the drilling rod when the taphole depth according to the position detection becomes equal to or deeper than a set value and the detected pressure becomes equal to or lower than a lower limit set value for detecting that the taphole has been perforated;

stopping the driving but maintaining the rotation when, during the forward driving of the drilling rod, said detected pressure reaches an upper limit set value beyond which buckling may occur; and resuming the driving when said detected pressure falls to a lower limit set value or below.

4. An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected pressure;

setting the count of position detection to zero when the detected pressure exceeds an upper limit set value for detecting that the drill unit has reached a plugging material in the taphole, commencing position detection from this position, and calculating the depth of the taphole;

stopping the driving of the drilling rod when the taphole depth according to the position detection becomes equal to or deeper than a set value and the detected pressure becomes equal to or lower than a lower limit set value for detecting that the taphole has been perforated;

maintaining the impact when, during the forward driving of the drilling rod, said detected pressure is equal to or higher than a set value to commence the impacts; and stopping the impact when said detected pressure is lower than said set value.

5. An automatic control method for a hydraulic taphole opener for opening a taphole by giving impact and rotation to a drill unit holding a drilling rod and driving the drill unit forward and backward by a hydraulically driven feed motor, which method comprises the steps of:

detecting the driving load in the form of detected pressure;

setting the count of position detection to zero when the detected pressure exceeds an upper limit set value for detecting that the drill unit has reached a plugging material in the taphole, commencing position detection from this position, and calculating the depth of the taphole;

stopping the driving of the drilling rod when the taphole depth according to the position detection becomes equal to or deeper than a set value and the detected pressure becomes equal to or lower than a lower limit set value for detecting that the taphole has been perforated;

stopping the driving but maintaining the rotation when, during the forward driving of the drilling rod, said detected pressure reaches an upper limit set value beyond which buckling may occur;

resuming the driving when said detected pressure falls to a lower limit set value or below;

further, maintaining the impact when, during the forward driving of the drilling rod, said detected pressure is equal to or higher than a set value to commence the impact; and stopping the impact when said detected pressure is lower than said set value.

* * * * *